US006592403B2

(12) United States Patent
Kooiman

(10) Patent No.: US 6,592,403 B2
(45) Date of Patent: Jul. 15, 2003

(54) COAXIAL CONNECTOR SWIVEL INTERFACE

(75) Inventor: John A. Kooiman, Peoria, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 10/045,772

(22) Filed: Nov. 9, 2001

(65) Prior Publication Data

US 2003/0092317 A1 May 15, 2003

(51) Int. Cl.[7] ..... H01R 9/05
(52) U.S. Cl. ..... 439/578; 439/585
(58) Field of Search ..... 439/578, 583, 439/584, 585, 310, 311, 322; 174/65, 78, 87, 35 C

(56) References Cited

U.S. PATENT DOCUMENTS

| | | | | |
|---|---|---|---|---|
| 3,517,371 A | | 6/1970 | Buckley | 339/89 |
| 3,739,076 A | * | 6/1973 | Schwartz | 174/78 |
| 5,083,943 A | * | 1/1992 | Tarrant | 439/583 |
| 5,352,134 A | * | 10/1994 | Jacobse et al. | 439/584 |
| 5,449,296 A | | 9/1995 | Jacobsen et al. | 439/322 |

FOREIGN PATENT DOCUMENTS

| | | |
|---|---|---|
| EP | 0 671 781 | 2/1997 |
| FR | 2.003.198 | 11/1969 |

* cited by examiner

*Primary Examiner*—Alexander Gilman
(74) *Attorney, Agent, or Firm*—Cahill, von Hellens & Glazer P.L.C.

(57) ABSTRACT

A coaxial connector for connecting a coaxial member to a mating component includes a front body, a rear body, a center conductor, and a nut. The nut surrounds the front body and is locked against rotation relative to the front body; however, the nut can slide axially relative to the front body. A first end of the front body has a threaded surface for engaging a mating threaded component. The rear body includes a central bore coaxial with the longitudinal axis of the front body. A first end of the rear body surrounds the second end of the front body and is rotatably and slidably secured thereto, as by a retaining ring, between retracted and extended positions. The second end of the rear body is adapted to engage a coaxial member, e.g., the end of a coaxial cable. The center conductor is supported within the central bore of the front body by a supporting insulator to electrically and mechanically couple a center conductor of the coaxial member to a center conductor of the aforementioned mating component. As the first end of the front body is threadedly engaged with the mating component, the nut bears against the rear body and pushes it away from the front body. An O-ring is disposed between the second end of the front body and the central bore of the rear body; the O-ring is compressed to form a seal as the nut forces the rear body toward its extended position away from the front body.

17 Claims, 4 Drawing Sheets

COAXIAL CONNECTOR SWIVEL INTERFACE

BACKGROUND OF THE INVENTION

1. Field of the Invention

The present invention relates generally to coaxial connectors for securing devices such as coaxial cables to connectors of equipment boxes or other coaxial components, and more particularly, to an improved coaxial connector that permits two mating connectors to be screwed together, or unscrewed from each other, without requiring that the main body of either connector be rotated.

2. Description of the Related Art

The cable television (CATV) industry within the United States, through the organization known as The Society of Cable Telecommunications Engineers, Inc. (SCTE) of Exton, Pa., has long since standardized on a Radio Frequency Coaxial Connector Interface known as the "KS" interface for use in trunk and distribution applications for CATV and high speed digital signals. These "KS" interface connectors are typically used to attach the end of a coaxial cable to a port on an amplifier housing, or other similar equipment. However, the "KS" interface is subject to several problems. Chief among these problems is that the SCTE "KS" interface specifications make no provision for a coupling apparatus or coupling method that could allow two mating connectors to be screwed together, or unscrewed from each other, without rotating one of the two connector bodies.

The most common method for dealing with this problem is to use a two-piece connector, or three-piece connector, that includes at least a so-called front body and a rear body; an example of such a connector is shown in U.S. Pat. No. 4,854,893, owned by the assignee of the present invention. The '893 patent discloses a two-piece coaxial cable connector wherein the rear nut body is engaged over the exposed end of a coaxial cable and engages the outer conductor of the coaxial cable. The front nut body includes a center pin that seizes the center conductor of the coaxial cable as the front nut body is tightened over the rear nut body. When disconnecting such a two-piece connector from an internally-threaded port of an equipment box, the two-piece connector must first be disassembled from the coaxial cable, so that the front nut body may be unscrewed from the equipment housing without twisting the coaxial cable. This is obviously more complicated and time consuming than simply unscrewing a coupling nut, as is the case with most other types of coaxial connectors.

In many cases, it would be highly desirable to allow the mating of two connectors without the need to disassemble either connector, and without the need to rotating either connector body. For example, in the case of a factory-made jumper cable assembly, equipped with coaxial connectors at each end of such cable, the end connectors cannot be removed from the cable assembly, and it would be impossible to mate such a jumper to two fixed pieces of equipment without somehow disassembling one or both of such end connectors. The nature of the standardized KS interface precludes the use of a simple rotatable coupling nut from being used to secure the connectors to mating ports because the coupling nut would "bottom-out" before the main body of the connector "bottoms-out"; this would leave the main body of the connector loose, and without a proper electrical ground connection. Moreover, the standardized "KS" interface is dimensionally incomplete, and accordingly allows a wide range of dimensions that can cause compatibility problems between various manufacturers.

The most common approach toward dealing with the above-described problem is to use a coupling nut in conjunction with a jam nut. The coupling nut is first tightened against the equipment housing; then, the jam nut is tightened against the coupling nut in order to take up any slack between the coupling nut and connector body. It is usually necessary to form wrench flats on the connector body for allowing an installer to apply a wrench to the connector body to prevent it from rotating while the coupling nut and jam nut are being tightened. However, the need to apply wrenches to the coupling nut, jam nut, and connector body presents an awkward and confusing situation, and one that is prone to error. For example, it is not uncommon for an installer to tighten the nuts is the wrong order, or to have one nut loosen while the other is being tightened. The end result is loose connections in the field.

In addition, prior art seizing mechanisms, used within female coaxial connectors to seize the central conductor of the male connector, rely upon the distance that the front, male body of the coaxial connector protrudes into the rear, female body to activate the seizing mechanism. The SCTE interface specifications allows this distance to vary from 0.290" to 0.370", and this permitted variation distance is too large to ensure consistent performance of any seizing mechanism that relies upon this dimension. Moreover, such seizing mechanisms within female connectors typically have sharp edges which can rub against, and damage, the protective coating ordinarily plated upon the center conductor of the male connector if the seizing mechanism and center conductor are allowed to rotate with respect to one another during tightening of the male connector to the female connector.

Accordingly, it is an object of the present invention to provide a coaxial connector for connecting the end of a coaxial member to a mating component wherein the two mating connectors can be coupled together, or uncoupled from each other, without requiring that the main body of either connector be rotated.

Another object of the present invention is to provide such a coaxial connector that avoids the need for disassembly of two or more pieces of the connector from a coaxial cable in order to disengage the connector from the mating component.

Still another object of the present invention is to provide such a coaxial connector that is relatively easy to use and inexpensive to manufacture.

Yet another object of the present invention is to provide such a coaxial connector that can be coupled with a mating component by a field technician in a relatively quick manner.

A further object of the present invention is to provide such a coaxial connector that is relatively insensitive to the wide dimensional variations allowed by the SCTE interface specifications, thereby assuring the compatibility of such coaxial connectors with mating components produced by various other manufacturers.

A still further object of the present invention is to provide such a coaxial connector that can be securely tightened in a simple manner akin to the tightening of a conventional coupling nut, but which may also include an internal actuating mechanism, actuated during the tightening process, to accomplish additional desired functions, such as seizing the center conductor of the mating connector with great force.

Another object of the present invention is to provide such a connector that can form a weather-tight seal, while avoiding any significant drag on any rotatable components until the rotatable component approaches its fully mated condition, thereby allowing such connector to be quickly hand tightened initially, and requiring a wrench only for the last few turns.

Yet another object of the present invention is to provide such a coaxial connector which enhances the reliability and stability of the connector by providing low and stable contact resistance and preventing any mechanical movement as between the coaxial connector and the coaxial conductors joined thereto.

An additional object of the present invention is to prevent any relative rotation as between the center conductor/center contact mechanism that electrically joins the coaxial connector and its mating coaxial component as the outer conductor of the coaxial conductor is tightened onto the outer conductor of its mating component, thereby avoiding damage to the plating applied to such center conductor/center contact mechanism that might otherwise result when sharp edges of the center contact mechanism rub against the coating plated upon the center conductor.

These and other objects of the present invention will become more apparent to those skilled in the art as the description of the present invention proceeds.

SUMMARY OF THE INVENTION

Briefly described, and in accordance with a preferred embodiment thereof, the present invention relates to a coaxial connector used to connect the end of a coaxial member, such as a coaxial cable, to a mating component, and including a front body, a rear body rotatably secured the front body, a center conductor extending within the front body, and a nut that surrounds the front body and is secured thereto in such manner that it can slide axially relative to the front body, but it is substantially locked against rotation relative to the front body.

The front body includes a central bore and extends between first and second opposing ends along a longitudinal axis; the first end of the front body has a threaded surface for engaging a mating threaded component. This threaded surface can be formed upon an external surface of the first end of the front body for mating with a female connector; alternatively, this threaded surface can be formed upon an internal surface of the first end of the front body for mating with male connector.

The rear body includes a central bore coaxial with the longitudinal axis of the front body; a first end of the rear body surrounds the second end of the front body.and is rotatably secured thereto in a manner which allows the front body to be movable, relative to the rear body, along the longitudinal axis between retracted and extended positions. Preferably, this coupling is effected by a retaining ring extending within an annular recess formed in the central bore of the rear body proximate its first end, and further extending within an annular recess formed within the external surface of the front body proximate the second end thereof. The second end of the rear body is adapted to engage a coaxial member, e.g., the end of a coaxial cable.

A center conductor is supported within the central bore of the front body along its longitudinal axis, and further extends within the central bore of the rear body. This center conductor is adapted to electrically and mechanically couple a center conductor of the coaxial member (e.g., the center wire of a coaxial cable) to a center conductor of the aforementioned mating component (e.g., a mating connector). Preferably, a supporting insulator is included in the central bore of the front body to help support such center conductor, while permitting the front body to rotate about, and move along, the longitudinal axis of the center conductor.

In the case where the first end of the front body is internally threaded for receiving a male mating connector having a male center conductive pin, a first end of the female center contact preferably includes a slotted bore for receiving such male pin. In this example, the second end of the female center contact is preferably anchored within the central bore of the rear body, as by an anchoring insulator secured within the central bore of the rear body. The aforementioned supporting insulator has a central bore extending coaxially with the longitudinal axis of the front body for receiving the first end of the female center contact and for allowing the male pin to be inserted therein. Preferably, the central bore of the supporting insulator includes a tapered wall for radially compressing the slotted end of the female center contact as the front body and rear body move axially apart from each other, thereby capturing the male pin in the slotted bore of the female center contact.

The nut has a central aperture defined by an internal surface, and the front body extends through this central aperture. The internal surface of the nut engages the external surface of the front body in a manner which prevents substantial rotation of the nut relative thereto, while permitting the nut to slide axially along the front body relative to the longitudinal axis thereof. The nut includes first and second opposing side walls, and the first side wall is adapted to slidingly engage and abut the mating component to which the first end of the front body is to be secured. The opposing second side wall of the nut is adapted to slidingly engage and abut the first end of the rear body. Thus, as the threaded region at the first end of the front body is threadedly engaged with the mating component (e.g., a mating connector), the nut bears against the first end of the rear body and pushes the rear body away from the front body along the aforementioned longitudinal axis.

Preferably, an O-ring is disposed between the second end of the front body and the central bore of the rear body to form a seal therebetween. As the nut forces the rear body toward its extended position away from the front body, the O-ring is compressed to form a seal between the second end of the front body and the first end of the rear body. If desired, a second O-ring can be included within or upon the first end of the front body to form a seal with the aforementioned mating component (e.g., a mating connector). In the case where the first end of the front body is externally threaded, the central aperture of the nut preferably extends over and around such second O-ring before the front body is mated with the mating component.

The present invention also relates to a method of assembling a coaxial connector of the type described above. The method includes the step of providing a front body having first and second opposing ends and having a central bore extending along a longitudinal axis; as described above, the first end of the front body has a threaded region for threadedly engaging a mating threaded component. The second end of the front body has an external surface that initially tapers outwardly to a peak and then tapers back inwardly. The method also includes the step of providing a rear body having first and second opposing ends and having a central bore coaxial with the longitudinal axis of the front body. The first end of the rear body is adapted to receive the second end of the front body; the second end of the rear body is adapted to receive a coaxial conductor. The rear body includes an annular O-ring recess formed within the central bore thereof The method includes the further step of disposing a center conductor within the central bore of the front body along its longitudinal axis. In addition, an O-ring is inserted into the annular O-ring recess of the rear body.

In practicing the foregoing method, the second end of the front body is inserted into the first end of rear body until the peak of the front body engages the O-ring; thereafter, one continues to insert the second end of the front body into the first end of the rear body, while allowing the peak to compress the O-ring into the annular O-ring recess of the rear body as the peak passes the O-ring. One continues to advance the second end of the front body into the first end of the rear body, allowing the peak to clear the O-ring.

The above-described method preferably includes the additional step of rotatably securing the front body to the rear body by forming an annular recess on an external surface of the front body, forming an annular retaining ring recess within the central bore of the rear body, inserting a compressible retaining ring into the annular recess of the front body, and advancing the second end of the front body into the first end of the rear body until the retaining ring expands into the annular retaining ring recess of the rear body. Ideally, the annular retaining ring recess of the rear body is formed to be wider than the thickness of the retaining ring for allowing the front body and rear body to slide axially with respect to each other.

The above-described method may optionally include the additional steps of providing a nut having a central aperture defined by an internal surface, sliding the nut over the second end of the front body before the second end of the front body is inserted into the first end of rear body, and engaging the internal surface of the nut with the external surface of the front body to prevent substantial rotation of the nut relative to the front body, while permitting the nut to be axially slidable along the front body relative to the longitudinal axis of the front body.

DETAILED DESCRIPTION OF THE PREFERRED EMBODIMENTS

Figure 1:
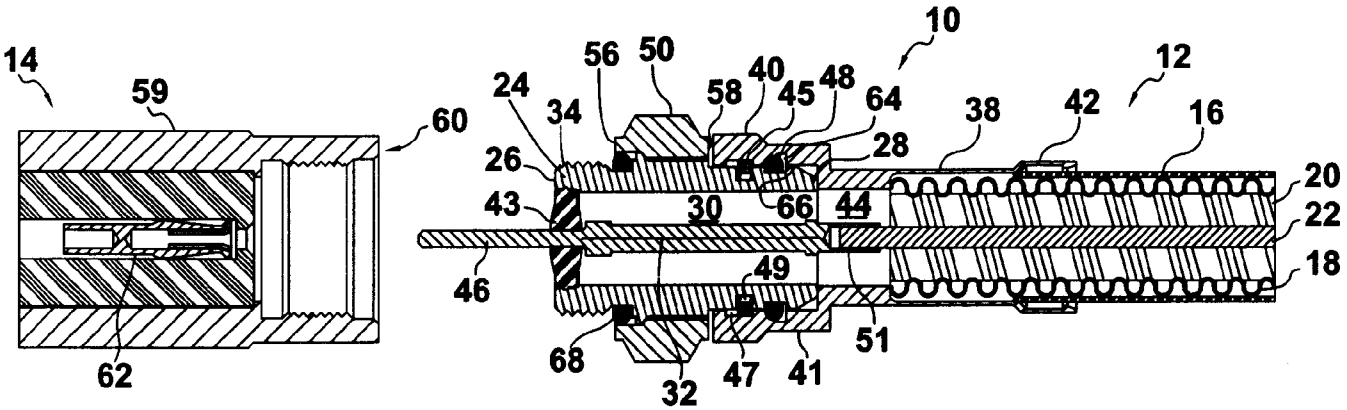
FIG. 1 is a cross-sectional view of a male coaxial connector made in accordance with a preferred embodiment of the present invention, secured to the end of a coaxial cable, and further illustrating a mating female component to which such connector is to be coupled.
Figure 2:
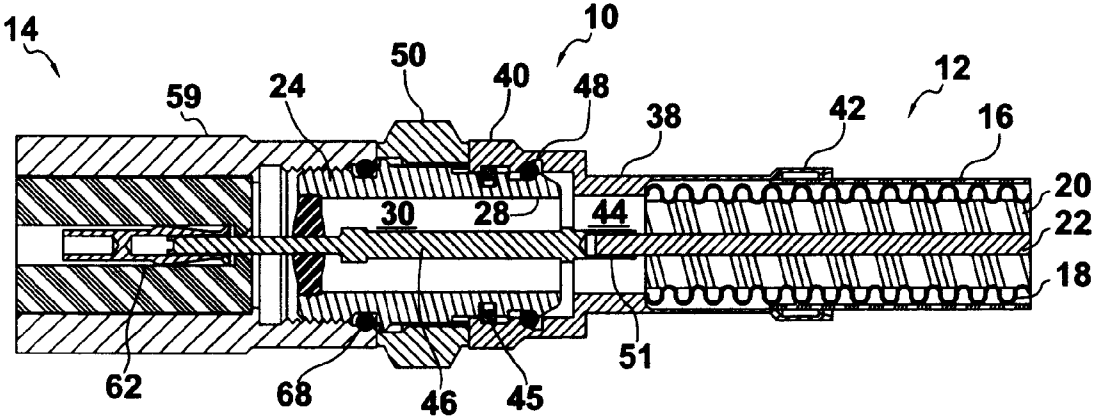
FIG. 2 is a cross-sectional view of the coaxial connector and mating component shown in FIG. 1 after they are threaded together.
Figure 7:
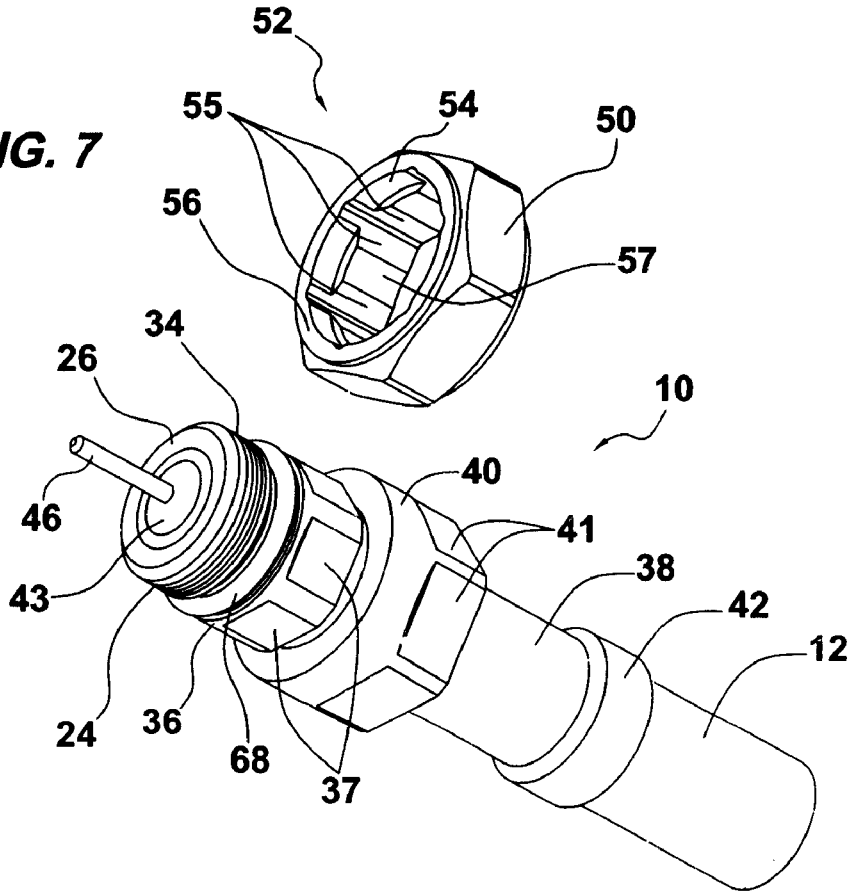
FIG. 7 is a perspective view of the male connector shown in FIGS. 1 and 2, but with the nut removed and separated therefrom.

FIGS. 1, 2 and 7 illustrate a first embodiment of a male coaxial connector constructed in accordance with the present invention. Within FIGS. 1, 2 and 7, the male coaxial connector is designated generally by reference numeral 10. Connector 10 serves to connect the end of a coaxial member, such as coaxial cable 12, to a mating component, e.g., female connector 14. Coaxial cable 12 includes an outer protective jacket 16, a corrugated outer metallic conductor 18, an insulative dielectric 20, and a central conductor 22.

Male connector 10 includes a front body 24 which extends between first and second opposing ends 26 and 28, respectively. Front body 24 has a central bore 30 extending along a longitudinal axis designated in FIG. 1 by dashed lines 32. First end 26 of front body 24 includes a threaded region 34 for releasably engaging first end 26 front body 24 with mating threaded component 14. Front body 24 includes an external surface 36 best seen in FIG. 7. As shown in FIG. 7, a central portion of the external surface 36 of front body 24 has an enlarged "diameter" and has a series of flats 37 formed thereon, the function of which is set forth below.

Male connector 10 also includes a rear body 38 having a first end 40 and an opposing second end 42. Rear body 38 includes a central bore 44 coaxial with longitudinal axis 32 of front body 24. The first end 40 of rear body 38 surrounds second end 28 of front body 24 and is rotatably secured thereto, as by a retaining ring 45. Retaining ring 45 is shown in greater detail in FIG. 8. It will be noted that first end 40 may also have hexagonal flats 41 formed thereupon for receiving the jaws of a wrench. Second end 42 of rear body 38 is adapted to mechanically and electrically engage outer conductor 18 of coaxial cable 12. As shown in FIGS. 1 and 2, second end 42 of rear body 38 may also engage the outer jacket 16 of coaxial cable 12.

Figure 8:
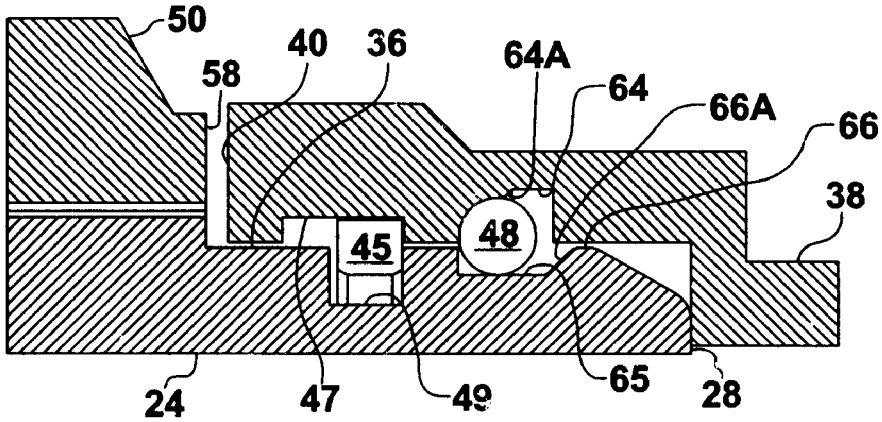
FIG. 8 is an enlarged sectional view of an O-ring seal and split retaining ring disposed between the front body and rear body of the connector.

Retaining ring 45 is a split metal ring having an uncompressed outer diameter that is slightly larger than the outer dimension of front body 24. As shown in FIG. 8, the central bore of rear body 38 includes an annular recess 47 proximate first end 40 thereof, and retaining ring 45 seats itself in annular recess 47. Likewise, front body 24 has an annular recess 49 formed within its external surface 36 proximate its second end 28, and retaining ring 45 is also engaged by annular recess 49 for rotatably securing second end 28 of front body 24 to first end 40 of rear body 38.

Moreover, it will be noted that annular recess 47 is significantly wider than retaining ring 45, which allows for some axial sliding motion as between second end 28 of front body 24 and first end 40 of rear body 38. For example, in FIGS. 1 and 8, retaining ring 45 engages the edge of annular recess 47 that lies furthest to the right in the drawing, whereas, in FIG. 2, retaining ring 45 engages the edge of annular recess 47 that lies furthest to the left in the drawing. Accordingly, in FIG. 1, front body 24 is inserted into rear body 38 as much as possible such that second end 28 of front body 24 is near, or actually contacts, rear body 38; in contrast, in FIG. 2, front body 24 and rear body 38 are pulled somewhat apart, creating a gap between second end 28 of front body 24 and rear body 38. Thus, front body 24 is not only rotatable relative to rear body 38; front body 24 is also movable somewhat along longitudinal axis 32 relative to rear body 38 between a retracted position (see FIGS. 1 and 8) and an extended position (see FIG. 2).

Male connector 10 also includes a center conductor, or metallic center pin 46, supported along longitudinal axis 32 of front body 24. Center pin 46 extends within central bore 30 of front body 24; it also extends partially into central bore 44 of rear body 38. An insulator 43 is disposed within central bore 30 of front body 24 near first end 26 thereof to provide support for center pin 46. Preferably, insulator 43 rotatably supports center pin 46, allowing front body 24 to rotate even when center pin 46 is stationary. One end 51 of center pin 46 is hollow, and is fastened to the center conductor 22 of coaxial cable 12, preferably by soldering. As shown in FIG. 2, the opposing, exposed end of center pin 46 is adapted to be engaged by a hollow, slotted female port 62 of mating component 14.

Male connector 10 also preferably includes an O-ring 48 to form a weather-tight seal between front body 24 and rear body 38. As shown best in FIG. 8, an annular recess 64 is formed in the central bore 44 of rear body 38 to partially contain O-ring 48. O-ring 48 also bears against the external surface 36 of front body 24 proximate second end 28 thereof. Preferably, the portion of external surface 36 of front body 24 that lies opposite annular recess 64 of rear body 38 is configured to have a first lesser diameter, or flat area 65, when front body 24 is fully advanced into rear body 38 (see FIGS. 1 and 8), but tapers outward toward a peak 66 having a larger second diameter when front body 24 is extended away from rear body 38 (see FIG. 2). Thus, when front body 24 is retracted within rear body 38, O-ring 48 is not significantly compressed, and front body 24 is free to rotate relative to rear body 38. However, if front body 24 is forced away from rear body 38 toward its extended position, O-ring 48 becomes compressed between angled surface 64A (see FIG. 8) of rear body 38 and angled surface 66A (see FIG. 8) of front body 24, forming a weather-tight seal therebetween.

As shown in FIGS. 1, 2 and 7, male connector 10 also includes an outer nut 50. Nut 50 has a central aperture 52 defined by internal surface 54. As shown best in FIG. 7, internal surface 54 is configured as a hexagon, and has flats 55 formed thereupon. Each flat 55 has a central radiussed undercut 57 formed therein for ease of manufacture. Central aperture 52 is slightly larger than the greatest cross-sectional dimension of front body 24, thereby allowing front body 24 to extend through central aperture 52 of nut 50; the flats 55 formed upon internal surface 54 of nut 50 engage the flats 37 formed upon external surface 36 of front body 24 to effectively prevent substantial rotation of nut 50 relative to front body 24. Thus, if nut 50 is rotated, then front body 24 rotates with it. On the other hand, flats 55 and flats 37 are free to slide across one another in the direction of longitudinal axis 32; accordingly, nut 50 is axially slidable along front body 24 relative to longitudinal axis 32, i.e. at least until nut 50 is precluded from further axial movement by contact with some other component.

Nut 50 includes first and second opposing side walls 56 and 58, respectively. First side wall 56 is adapted to engage and abut front end 60 of mating component 14 when male connector 10 is threadedly secured to mating component 14, as shown in FIG. 2. Second side wall 58 is adapted to engage and abut first end 40 of rear body 38 when male connector 10 is threadedly secured to mating component 14, as shown in FIG. 2.

In actual use, second end 42 of rear body 38 is engaged over the prepared end of a coaxial cable 12. If desired, solder can be applied to electrically and mechanically connect outer conductor 18 of cable 12 with central bore 44 of rear body 38. Center conductor 22 of cable 12 is simultaneously engaged within bore 51 of center pin 46, and may be soldered thereto, if desired. Let it now be assumed that connector 10 is to be joined with mating connector 14, and that both mating connector 14 and cable 12 should not be twisted or rotated in making such connection. Front end 26 of front body 24 is inserted into the front end 60 of mating component 14, while sliding center pin 46 into slotted center aperture 62. The field technician then begins to rotate nut 50 by hand to engage external threads 34 of front body 24 with the internal threads formed within front end 60 of mating connector 14. It will be remembered that nut 50 and front body 24 rotate as one. Front body 24 is free to rotate within rear body 38, so cable 12 is not twisted or rotated during this procedure. Initially, O-ring 48 is not compressed, and does not exert any significant drag on the rotation of nut 50 or front body 24. Accordingly, the field technician can quickly rotate nut 50 and front body 24 by hand until almost tight without the aid of a wrench. Note that an additional O-ring 68 can be disposed upon the external surface of front body 24 generally proximate first end 26 thereof, and just behind threaded region 34, if desired, to achieve a weather-tight seal between front body 24 and mating connector 14. It will also be noted that central aperture 54 of nut 50 can initially extend over second O-ring 68 (see FIG. 1) before front body 24 is mated with mating component 14.

As male connector 10 approaches its fully tightened position within mating connector 14, side wall 56 of nut 50 engages front end 60 of connector 14. Now, as nut 50 is further rotated, and as threaded region 34 of front body 24 becomes further threaded into mating connector 14, nut 50 is forced to slide axially toward cable 12. In turn, opposing side wall 58 of nut 50 is forced against second end 40 of rear body 38. Accordingly, the last one or two turns of nut 50, preferably performed with a wrench, cause front body 24 to move from its retracted position (see FIGS. 1 and 8) to its extended position (see FIG. 2), i.e., front body 24 and rear body 38 move apart from each other. At the same time, O-ring 48 becomes compressed between surface 66A of front body 24 and surface 64A of rear body 38, thereby forming a seal between front body 24 and rear body 38. Should it be necessary to later uncouple cable 12 from mating connector 14, a field technician may simply reverse the procedure described above, again without the need to rotate either cable 12 or mating connector 14.

Turning to FIGS. 3–6 and FIG. 9, a second embodiment of the present invention is illustrated in the form of a female coaxial connector. Within FIGS. 3–6, the female coaxial connector is designated generally by reference numeral I 10, and is used to connect the end of a coaxial member, like coaxial cable 112, to a mating component, e.g., male connector 114. coaxial cable 112 has the same structure as cable 12 of FIG. 1, including jacket 116, outer conductor 118, dielectric 120, and central conductor 122.

Figure 3:
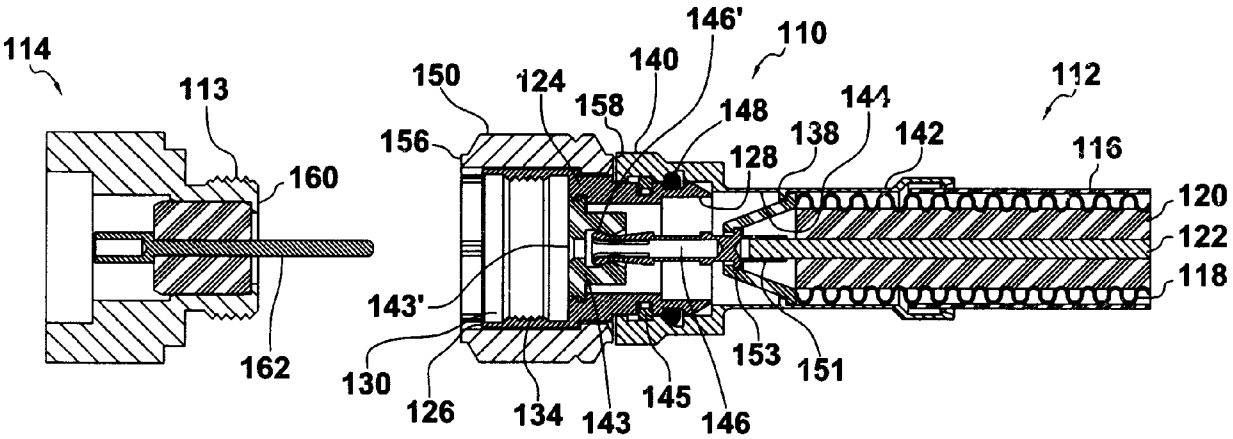
FIG. 3 is a cross-sectional view of a female coaxial connector made in accordance with a preferred embodiment of the present invention, secured to the end of a coaxial cable, and further illustrating a mating male component to which such connector is to be coupled.

Female connector 110 includes front body 124 having a central bore 130 extending along the longitudinal axis thereof. First end 126 of front body 124 includes internally-threaded region 134 for releasably engaging externally-threaded region 113 of mating component 114. Front body 124 includes an external surface 136 (see FIG. 7), and the central portion of external surface 136 has a series of flats 137 formed thereon. Female connector 110 also includes rear body 138 having central bore 144 coaxial with the longitudinal axis of front body 124. First end 140 of rear body 138 surrounds second end 128 of front body 124 and is rotatably secured thereto by retaining ring 145. Once again, retaining ring 145 is seated within annular recesses in a manner which permits a degree of axial sliding motion between second end 128 of front body 124 and first end 140 of rear body 138. In FIG. 3, front body 124 is inserted into rear body 138 as much as possible, corresponding to the retracted position of front body 124; in FIG. 4, front body 124 and rear body 138 are pulled apart, corresponding to the extended position of front body 124. Second end 142 of rear body 138 is adapted to mechanically and electrically engage outer conductor 118 of coaxial cable 112, and may also engage jacket 116.

Female connector 110 also includes a center conductor seizing mechanism for selectively seizing the male center pin 162 of mating connector 114, and providing a central conductive path between center pin 162 and the central conductor 122 of cable 112. Female connector 110 includes a female center contact 146. First end 146' of female center contact 146 extends within central bore 130 of front body 124, and has a slotted bore formed therein for receiving center pin 162. Second end 151 of female center contact 146 is anchored within central bore 144 of rear body 138 by a cone-shaped insulator 153; second end 151 of female center contact 146 is hollow to receive the center conductor 122 of coaxial cable 112, and may be soldered or otherwise attached thereto. A further insulator 143 is anchored within central bore 130, and includes a central bore 143' for receiving center pin 162. Insulator 143 aids in centering and supporting center pin 162. In addition, the central bore 143' of insulator 143 includes a tapered central chamber, shown best in FIG. 9, for receiving, and selectively compressing, slotted first end 146' of female center contact 146.

Figure 4:
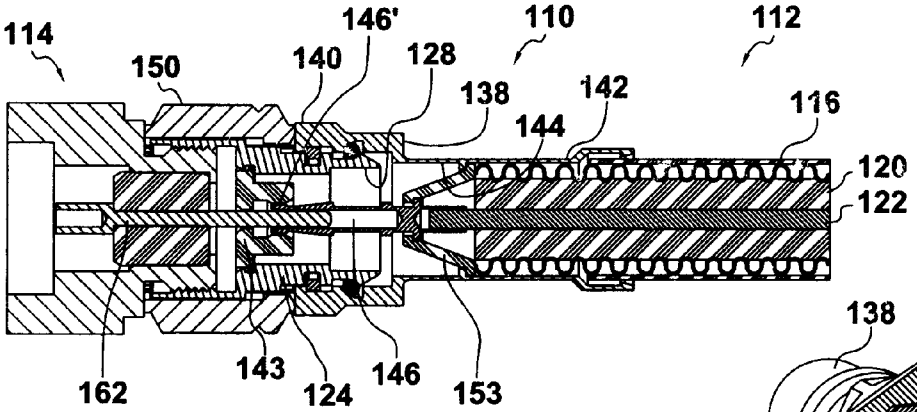
FIG. 4 is a cross-sectional view of the coaxial connector and mating component shown in FIG. 3 after they are threaded together.
Figure 5:
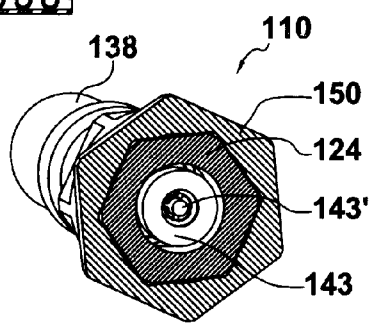
FIG. 5 is a sectioned, perspective view of the connector shown in FIGS. 3 and 4, sliced to illustrate the locking engagement between hexagonal flats formed upon the inner surface of the nut and corresponding hexagonal flats formed upon the outer surface of the front body.
Figure 6:
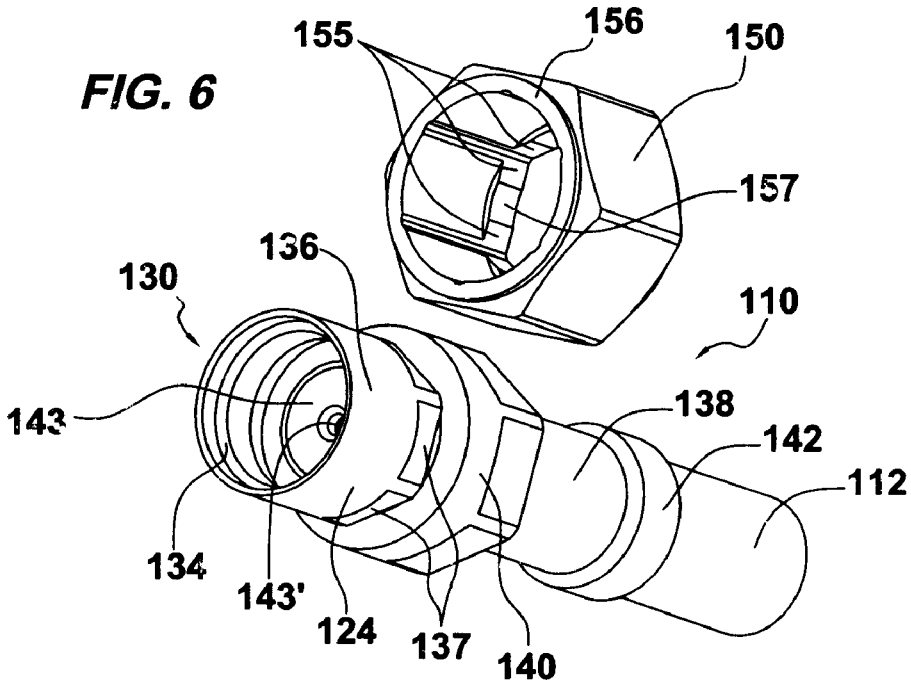
FIG. 6 is a perspective view of the female connector shown in FIGS. 3 and 4, but with the nut removed and separated therefrom.
Figure 9:
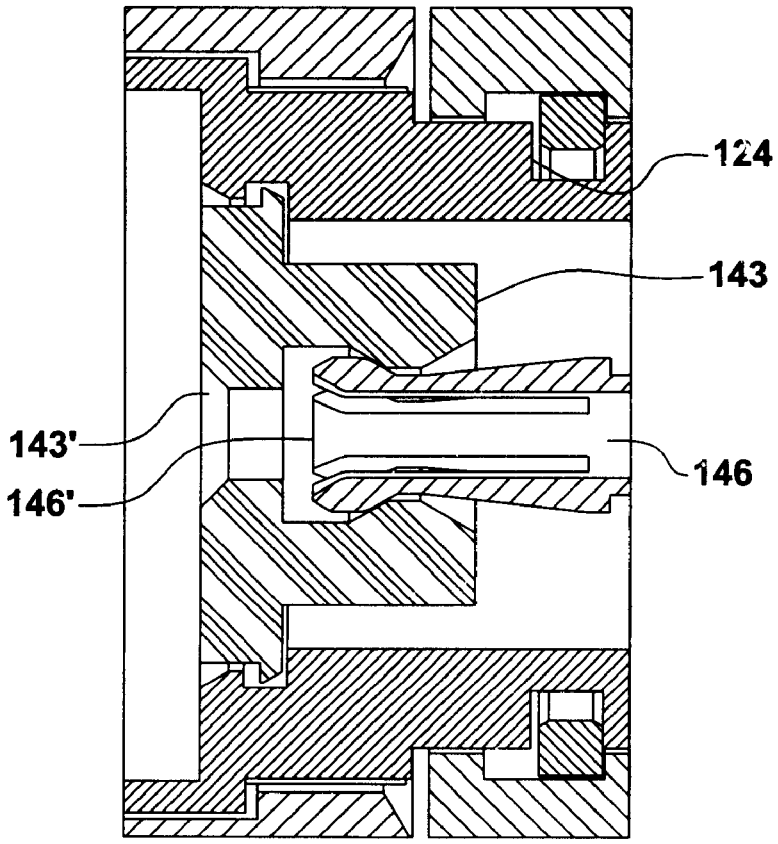
FIG. 9 is an enlarged sectional view of the seizing mechanism shown in FIGS. 3 and 4.

Before connector 110 is connected to mating component 114 (i.e., front body 124 is in its retracted position of FIG. 3), slotted end 146' of female center contact 146 is allowed to fully extend within the aforementioned central chamber of insulator 143', as shown in FIGS. 3 and 9. Accordingly, the slotted end 146' of female center contact 146 is not compressed, and male center pin 162 can easily be inserted into such slotted end 146'. However, when front body 124 advances to its extended position, as shown in FIG. 4, slotted end 146' of female center contact 146 is radially compressed inwardly by the tapered wall portion of the central bore 143' of insulator 143, thereby seizing center pin 162.

As in the case of male connector 10, female connector 110 preferably includes an O-ring 148 to form a weather-tight seal between front body 124 and rear body 138. Since such O-ring functions in precisely the same manner in this second embodiment as it did in the previously described first embodiment, it will not be further described. It should be sufficient to understand that, when front body 124 is retracted within rear body 138, O-ring 148 is not significantly compressed, and front body 124 is free to rotate relative to rear body 138. In contrast, when front body 124 is forced away from rear body 138 toward its extended position, O-ring 148 becomes compressed to form a weather-tight seal therebetween. In addition, O-ring 148 also performs the function of a return spring, urging front body 124 to return to the retracted position when the connector 110 is disengaged. This return spring function helps to assure that the center conductor seizure mechanism 143/146' (see FIG. 9) disengages and releases its grip on the male pin 162, thereby easing the removal of mating male connector 114.

As in the case of the first embodiment shown in FIGS. 1, 2 and 7, the female connector 110 of FIGS. 3–6 also includes an outer nut 150 having central aperture 152 defined by internal surface 154, and including flats 155 formed thereupon. Again, each flat 155 has a central radiussed undercut 157 formed therein for ease of manufacture. Front body 124 extends through central aperture 152 of nut 150, and flats 155 formed inside nut 150 engage flats 137 formed upon front body 124 to rotationally lock nut 150 to front body On the other hand, flats 155 and flats 137 are free to slide axially relative to each other.

Nut 150 includes first and second opposing side walls 156 and 158. Nut 150 functions in substantially the same manner as previously described for nut 50 relative to the first embodiment. After securing second end 142 of rear body 138 to cable 112, front end 126 of front body 124 is inserted over front end 160 of mating component 114, while sliding center pin 162 into central bore 143' of insulator 143 (and hence, into slotted end 146' of female center contact 146). The field technician then begins to rotate nut 150 to engage internal threads 134 of front body 124 with external threads 113 formed within front end 160 of mating connector 114. It will be remembered that nut 150 and front body 124 rotate together as a unit. Front body 124 is free to rotate within rear body 138, so cable 112 is not twisted or rotated during this procedure. Initially, O-ring 148 is not compressed, and does not exert any significant drag on the rotation of nut 150 or front body 124. Accordingly, the field technician can quickly rotate nut 150 and front body 124 by hand until hand tight. As female connector 110 approaches its fully tightened position against mating connector 114, side wall 156 of nut 150 engages front end 160 of connector 114. Now, as nut 150 is further rotated, and as threaded region 134 of front body 124 becomes further threaded onto mating connector 114, nut 150 is forced to slide axially toward cable 112, and opposing side wall 158 bears against second end 140 of rear body 138. Accordingly, the last one or two turns of nut 150, preferably performed with a wrench, cause front body 124 to move from its retracted position (see FIG. 3) to its extended position (see FIG. 4). Simultaneously, O-ring 148 becomes compressed to form a seal between front body 124 and rear body 138, and slotted end 146' of female center contact 146 is radially compressed to seize center pin 162 of mating connector 114.

The above-described seizing mechanism serves to greatly enhance the reliability and stability of the connector by providing low and stable contact resistance, and by preventing any mechanical movement that could induce electrical noise, plating wear, possible corrosion at the contact point, and intermodulation or common path distortion. As mentioned earlier, prior art seizing mechanisms rely upon the distance by which the male connector protrudes into the female connector to activate the seizing mechanism. However, SCTE interface specifications allow such distance to vary from 0.290" to 0.370". This is too large of a variation for consistent performance of such a seizing mechanism. In contrast, the seizing mechanism described herein eliminates such problem by instead depending upon movement that takes place wholly inside the female connector, and which can be controlled independent of any dimensions of the male connector.

Assembly of the connectors described above is relatively straightforward. With respect to the male connector 10, center pin 46 and insulator 43 are inserted within front body 24, with center pin 46 extending along the longitudinal axis 32. Split ring 45 is pre-loaded onto front body 24 into annular recess 49. Similarly, O-ring 48 is pre-loaded into the annular recess 64 of rear body 38. Nut 50 is engaged over front body 24 such that flats 55 align with flats 37. Split ring 45 is then compressed into annular recess 49, and second end 28 of front body 24 is then inserted into first end 40 of rear body 38 until peak 66 engages O-ring 48. As front body 24 continues to enter second end 40 of rear body 38, peak 66 compresses O-ring 48 into annular recess 64 of rear body 38. The final advancement of front body 24 into rear body 38 causes peak 66 to pass and clear O-ring 48, and split ring 45 expands into recess 47.

Those skilled in the art will now appreciate that a coaxial connector for connecting the end of a coaxial member to a mating component has been described wherein the coaxial members that are being coupled together need not themselves be rotated during the coupling, or uncoupling, process. The described connector also avoids any need for disassembly of two or more pieces of the connector in order to disengage the connector from its mating component. In addition, it is relatively easy to use since a field technician can install and tighten, or loosen, such connector relatively quickly; it is also relatively inexpensive to manufacture. Those skilled in the art will also appreciate that the seizing technique described in conjunction with the female connector embodiment is relatively insensitive to the wide dimensional variations allowed by SCTE interface specifications, while providing low and stable contact resistance and preventing any mechanical movement as between the coaxial connector and the coaxial conductors joined thereto. In addition, the disclosed connectors form a weather-tight seal, without applying a noticeable drag on any rotatable components until the connector approaches its fully mated position relative to its mating component.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A coaxial connector for connecting the end of a coaxial member to a mating component, the coaxial connector comprising in combination:

a. a front body having first and second opposing ends and having a central bore extending along a longitudinal axis, the first end of the front body having a threaded region for threadedly engaging the first end of the front body to a mating threaded component, the front body having an external surface;

b. a rear body having first and second opposing ends and having a central bore coaxial with the longitudinal axis of the front body, the first end of the rear body surrounding the second end of the front body and being rotatably secured thereto, the second end of the rear body being adapted to engage at least the outer conductor of a coaxial member, the front body being movable along the longitudinal axis relative to the rear body between a retracted position and an extended position;

c. a center conductor supported along the longitudinal axis of the front body, the center conductor extending within the central bore of the front body and extending within the central bore of the rear body;

d. a nut having a central aperture defined by an internal surface, the front body extending through the central aperture of the nut, the internal surface of the nut engaging the external surface of the front body to prevent substantial rotation of the nut relative to the front body, the nut being axially slidable along the front body relative to the longitudinal axis of the front body, the nut including first and second opposing side walls, the first side wall being adapted to slidingly engage and abut the mating component, and the second side wall being adapted to slidingly engage and abut the first end of the rear body to axially move the front body and rear body apart from each other as the threaded region of the front body is threadedly engaged with the mating component.

2. The coaxial connector recited by claim 1 wherein the threaded region is formed upon an external surface of the first end of the front body.

3. The coaxial connector recited by claim 1 wherein the central bore of the rear body includes an annular recess proximate the first end thereof, wherein the external surface of the front body includes an annular recess proximate the second end thereof, and further including a retaining ring extending within the annular recesses of the front body and rear body for rotatably securing the second end of the front body to the first end of the rear body.

4. The coaxial connector recited by claim 1 including an insulator disposed within the central bore of the front body to support the center conductor.

5. The coaxial connector recited by claim 4 wherein the insulator rotatably supports the center conductor, and wherein the center conductor can rotate relative to the insulator.

6. The coaxial connector recited by claim 1 including an O-ring disposed between the second end of the front body and the central bore of the rear body, the O-ring being compressed to form a seal between the front body and the rear body as the front body approaches its extended position relative to the rear body.

7. The coaxial connector recited by claim 6 including a second O-ring disposed upon the external surface of the front body generally proximate the first end thereof to form a seal with the mating component.

8. The coaxial connector recited by claim 7 wherein the central aperture of the nut extends over the second O-ring before the front body is mated with the mating component.

9. The coaxial connector recited by claim 1 wherein the threaded region is formed upon an internal surface of the first end of the front body.

10. The coaxial connector recited by claim 3 wherein the center conductor has first and second opposing ends, the first end of the center conductor extending within the central bore of the front body, the second end of the center conductor being anchored within the central bore of the rear body, the first end of the center conductor having a bore formed therein for receiving a conductive pin of the mating component, the first end of the center conductor having at least one slot formed therein for allowing the first end of the center conductor to be radially compressed inward; and the coaxial connector further including a first insulator disposed inside the front body to aid in centering and supporting the first end of the center conductor, the first insulator including a central bore extending coaxially with the longitudinal axis of the front body for receiving the first end of the center conductor and for allowing the conductive pin to be inserted within the first end of the center conductor, the central bore of the first insulator having a tapered wall for radially compressing the first end of the center conductor as the front body and rear body move axially apart from each other as the threaded region of the front body is threadedly engaged with the mating component.

11. The coaxial connector recited by claim 10 including a second insulator disposed within the central bore of the rear body for supporting and anchoring the second end of the center conductor within the rear body.

12. The coaxial connector recited by claim 10 wherein the first end of the rear body is rotatably secured to the second end of the front body by a retaining ring.

13. The coaxial connector recited by claim 10 including an O-ring disposed between the second end of the front body and the central bore of the rear body, the O-ring being compressed to form a seal between the front body and the rear body as the front body approaches its extended position relative to the rear body, and the O-ring urging the front body toward its retracted position relative to the rear body when the coaxial connector is disengaged from a mating component, thereby releasing the conductive pin of the mating component from the first end of the center conductor.

14. A method of assembling a coaxial connector including the steps of:

a. providing a front body having first and second opposing ends and having a central bore extending along a longitudinal axis, the first end of the front body having a threaded region for threadedly engaging the first end of the front body to a mating threaded component, the front body having an external surface, the second end of the front body initially tapering outwardly to a peak and then tapering back inwardly;

b. providing a rear body having first and second opposing ends and having a central bore coaxial with the longitudinal axis of the front body, the first end of the rear body adapted to receive the second end of the front body, and the second end of the rear body being adapted to receive at least an outer coaxial conductor, the rear body including an annular O-ring recess formed within the central bore thereof;

c. disposing a center conductor within the central bore of the front body along the longitudinal axis thereof;

d. inserting an O-ring into the annular O-ring recess of the rear body;

e. inserting the second end of the front body into the first end of rear body until the peak of the front body engages the O-ring;

f. continuing to insert the second end of the front body into the first end of the rear body, while allowing the peak to compress the O-ring into the annular O-ring recess of the rear body as the peak passes the O-ring; and g. continuing to advance the second end of the front body into the first end of the rear body, allowing the peak to clear the O-ring.

15. The method recited by claim 14 including the steps of:

h. forming an annular recess on an external surface of the front body;

i. forming an annular retaining ring recess within the central bore of the rear body;

j. inserting a compressible retaining ring into the annular recess of the front body; and k. advancing the second end of the front body into the first end of the rear body until the retaining ring expands into the annular retaining ring recess of the rear body for rotatably securing the front body to the rear body.

16. The method recited by claim 15 wherein the retaining ring has a thickness, and wherein the annular retaining ring recess of the rear body is formed to be wider than the thickness of the retaining ring for allowing the front body and rear body to slide axially with respect to each other.

17. A method of assembling a coaxial connector including the steps of:

a. providing a front body having first and second opposing ends and having a central bore extending along a longitudinal axis, the first end of the front body having a threaded region for threadedly engaging the first end of the front body to a mating threaded component, the front body having an external surface, the second end of the front body initially tapering outwardly to a peak and then tapering back inwardly;

b. providing a rear body having first and second opposing ends and having a central bore coaxial with the longitudinal axis of the front body, the first end of the rear body adapted to receive the second end of the front body, and the second end of the rear body being adapted to receive at least an outer coaxial conductor, the rear body including an annular O-ring recess formed within the central bore thereof;

c. disposing a center conductor within the central bore of the front body along the longitudinal axis thereof;

d. inserting an O-ring into the annular O-ring recess of the rear body;

e. inserting the second end of the front body into the first end of rear body until the peak of the front body engages the O-ring;

f. continuing to insert the second end of the front body into the first end of the rear body, while allowing the peak to compress the O-ring into the annular O-ring recess of the rear body as the peak passes the O-ring;

g. continuing to advance the second end of the front body into the first end of the rear body, allowing the peak to clear the O-ring;

h. providing a nut having a central aperture defined by an internal surface;

i. sliding the nut over the second end of the front body before the second end of the front body is inserted into the first end of rear body; and j. engaging the internal surface of the nut with the external surface of the front body to prevent substantial rotation of the nut relative to the front body, while permitting the nut to be axially slidable along the front body relative to the longitudinal axis of the front body.

* * * * *